US006677007B1

(12) United States Patent
Warner et al.

(10) Patent No.: US 6,677,007 B1
(45) Date of Patent: Jan. 13, 2004

(54) IMAGE RECEPTOR MEDIUM AND METHOD OF MAKING AND USING SAME

(75) Inventors: Elizabeth A. Warner, Minneapolis, MN (US); Steven R. Austin, Oakdale, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/503,287

(22) Filed: Feb. 14, 2000

Related U.S. Application Data

(63) Continuation-in-part of application No. 09/249,110, filed on Feb. 12, 1999, now abandoned.

(51) Int. Cl.[7] ..... B41M 5/00
(52) U.S. Cl. ..... 428/32.34
(58) Field of Search ..... 428/195, 323, 428/32.34

(56) References Cited

U.S. PATENT DOCUMENTS

| | | | | |
|---|---|---|---|---|
| 4,247,498 | A | 1/1981 | Castro | 264/41 |
| 4,419,388 | A | 12/1983 | Sugiyama et al. | 427/288 |
| 4,474,847 | A | 10/1984 | Schroder et al. | 428/323 |
| 4,539,256 | A | 9/1985 | Shipman | 428/315.5 |
| 4,547,405 | A | 10/1985 | Bedell et al. | 427/256 |
| 4,554,181 | A * | 11/1985 | Cousin et al. | 427/261 |
| 4,613,441 | A | 9/1986 | Kohno et al. | 210/500.36 |
| 4,649,064 | A | 3/1987 | Jones | 427/256 |
| 4,726,989 | A | 2/1988 | Mrozinski | 428/315.5 |
| 4,732,786 | A | 3/1988 | Patterson et al. | 427/261 |
| 4,741,969 | A | 5/1988 | Hayama et al. | 428/514 |
| 4,775,594 | A | 10/1988 | Desjarlais | 428/421 |
| 4,781,985 | A | 11/1988 | Desjarlais | 428/421 |
| 4,867,881 | A | 9/1989 | Kinzer | 210/490 |
| 4,877,680 | A | 10/1989 | Sakaki et al. | 428/332 |
| 4,892,779 | A | 1/1990 | Leatherman et al. | 428/220 |
| 4,903,039 | A | 2/1990 | Light | 346/1.1 |
| 4,903,040 | A | 2/1990 | Light | 346/1.1 |
| 4,935,307 | A | 6/1990 | Iqbal et al. | 428/500 |
| 4,954,395 | A | 9/1990 | Hasegawa et al. | 428/318.4 |
| 5,079,319 | A | 1/1992 | Mueller | 526/238.23 |
| 5,084,340 | A | 1/1992 | Light | 428/327 |
| 5,102,731 | A | 4/1992 | Takimoto et al. | 428/323 |
| 5,120,594 | A | 6/1992 | Mrozinski | 428/195 |
| 5,126,194 | A | 6/1992 | Light | 428/327 |
| 5,126,195 | A | 6/1992 | Light | 428/327 |
| 5,137,778 | A * | 8/1992 | Nakatsugawa et al. | 428/330 |
| 5,141,790 | A | 8/1992 | Calhoun et al. | 428/40 |
| 5,147,410 | A | 9/1992 | Heindl et al. | 8/555 |
| 5,156,674 | A | 10/1992 | Cells | 106/20 |
| 5,206,071 | A | 4/1993 | Atherton et al. | 428/195 |

(List continued on next page.)

FOREIGN PATENT DOCUMENTS

| | | | |
|---|---|---|---|
| EP | 0 199 874 | 11/1986 | |
| EP | 0 457 728 A1 | 11/1991 | |
| EP | 0 484 016 A1 | 5/1992 | |
| EP | 0 570 515 B1 | 11/1993 | |
| EP | 0 614 771 A1 | 9/1994 | |
| EP | 0 627 324 A1 | 12/1994 | |
| EP | 0 661 168 A3 | 7/1995 | |
| EP | 0 667 246 A1 | 8/1995 | |
| EP | 0 673 782 A2 | 9/1995 | |
| EP | 0 716 931 A1 | 6/1996 | |
| EP | 0 736 392 | 10/1996 | |
| EP | 0 791 473 A2 | 8/1997 | |
| EP | 0 878 319 A2 | 4/1998 | |
| EP | 0 839 880 A1 | 5/1998 | |
| EP | 0 876 914 A1 | 11/1998 | |
| EP | 0 897 808 A1 | 2/1999 | |
| GB | 2 147 003 | 5/1985 | |
| JP | 61-063476 | 1/1986 | |
| JP | 61-41585 | 2/1986 | |
| JP | 61-261089 | 11/1986 | |
| WO | WO 93/01938 | 4/1993 | B41M/5/00 |
| WO | WO 93/25595 | 12/1993 | C08F/226/06 |
| WO | WO95/28285 | 10/1995 | |
| WO | WO 96/18496 | 6/1996 | B32B/3/00 |
| WO | WO 97/20697 | 6/1997 | B41M/5/00 |
| WO | WO97/33758 | 9/1997 | B41M/5/00 |
| WO | WO 98/05504 | 2/1998 | B41J/2/01 |
| WO | WO 98/05512 | 2/1998 | B41M/5/00 |
| WO | WO98/29516 | 7/1998 | C09J/7/02 |
| WO | WO98/30749 | 7/1998 | D06P/5/00 |
| WO | WO99/03685 | 1/1999 | |
| WO | WO99/06219 | 2/1999 | |
| WO | WO99/07558 | 2/1999 | |

OTHER PUBLICATIONS

Luvicross: Versatile Specialty Polymers for Technical Applications, BASF Luvicross Product Bulletin, www.basf.com, site visite Dec. 2001.*

*Encyclopedia of Polymer Science and Engineering*, vol. 17, pp. 204–214, 229, 234–235, John Wiley & Sons, Inc. (1989).

R.E. Kestings, *Synthetic Polymeric Membranes*: Structurual Perspective, 2d ed., John Wiley & Sons, 1985 Chapter 7, pp. 237–285.

Hornby et al., "Acrylidone Anionic Copolymers," International Specialty Products (brochure), Reprinted from *Soap/Cosmetics/Chemical Specialties* (Jun. 1993) 5 pgs.

International Specialty Products (brochure), Industrial Reference Guide, "Polymers—Polyvinylpryrrolidone," 2 pgs.

International Specialty Products (brochure), Polyvinylpyrrolidone Polymers, "PVP", 16 gs.

International Specialty Products (brochure), "Acrylidone™ Anionic Polymers," 6 pgs.

Porterfield, William W., *Inorganic Chemistry*, Addison–Wesley Publishing Company, Inc., p. 133 (1984).

*Primary Examiner*—B. Hamilton Hess
(74) *Attorney, Agent, or Firm*—Carolyn V. Peters

(57) ABSTRACT

An image receptor medium is disclosed as having a non-porous base medium and an imaging layer. The imaging layer includes a solvent-soluble multivalent cationic salt coated from an organic solvent. A water-insoluble binder holds the imaging layer together. The imaging layer also includes organic-solvent insoluble particulates. The image receptor medium can be backed with an adhesive/release liner combination or mechanical fasteners to provide securing means or can be left without such means for "drop-in" backlit uses.

22 Claims, No Drawings

U.S. PATENT DOCUMENTS 5,208,092 A 5/1993 Iqbal ..... 428/195
5,220,346 A 6/1993 Carreira et al.
5,229,207 A 7/1993 Paquette et al. ..... 428/355
5,262,238 A 11/1993 Trouve et al. ..... 428/402
5,296,277 A 3/1994 Wilson et al. ..... 428/40
5,302,437 A 4/1994 Idei et al. ..... 428/195
5,342,688 A 8/1994 Kitchin ..... 428/402
5,362,516 A 11/1994 Wilson et al. ..... 427/207.1
5,374,475 A 12/1994 Walchli ..... 428/304.4
5,380,044 A 1/1995 Aitkens et al. ..... 283/67
5,389,723 A 2/1995 Iqbal et al. ..... 525/57
5,428,383 A 6/1995 Shields et al. ..... 347/96
5,429,860 A 7/1995 Held et al. ..... 428/195
5,443,727 A 8/1995 Gagnon ..... 210/490
5,445,868 A 8/1995 Harasawa et al. ..... 428/206
5,500,668 A 3/1996 Mulhotra et al. ..... 347/105
5,518,534 A 5/1996 Pearlstine et al. ..... 106/20
5,537,137 A 7/1996 Held et al. ..... 347/105
5,569,529 A 10/1996 Becker et al. ..... 428/331
5,624,484 A 4/1997 Takahashi et al. ..... 106/31.75
5,640,187 A 6/1997 Kashiwazaki et al. ..... 347/101
5,677,067 A 10/1997 Kojima et al.
5,679,143 A 10/1997 Looman ..... 106/20 R
5,681,660 A 10/1997 Bull et al. ..... 428/500
5,683,793 A 11/1997 Malhotra et al. ..... 428/216
5,686,602 A 11/1997 Farooq et al. ..... 536/101
5,688,603 A 11/1997 Iqbal et al. ..... 428/532
5,695,820 A 12/1997 Davis et al. ..... 427/261
5,707,722 A 1/1998 Iqbal et al. ..... 428/304.4
5,731,430 A 3/1998 Fuertes et al. ..... 536/58
5,747,148 A 5/1998 Warner et al. ..... 428/212
5,789,342 A 8/1998 Evans et al. ..... 503/227
5,800,919 A 9/1998 Peacock et al. ..... 428/355
5,863,662 A 1/1999 Hornby et al. ..... 428/483
5,874,143 A 2/1999 Peloquin et al. ..... 428/40.1
5,885,337 A 3/1999 Nohr et al. ..... 106/31.27
6,054,213 A 4/2000 Peacock et al. ..... 428/355
6,071,614 A 6/2000 Farooq ..... 428/403
6,096,469 A * 8/2000 Anderson et al. ..... 430/119
6,110,601 A * 8/2000 Shaw-Klein et al. ..... 428/522
6,177,187 B1 1/2001 Niemoller et al. ..... 428/327
6,270,837 B1 * 8/2001 Liu et al. ..... 427/180

* cited by examiner

IMAGE RECEPTOR MEDIUM AND METHOD OF MAKING AND USING SAME

This application is a continuation-in-part of application Ser. No. 09/249,110 filed Feb. 12, 1999, now abandoned.

FIELD OF THE INVENTION

This invention relates to image receptor media for thermal or piezo inkjet printing wherein the media has a porous coating that contains a multivalent cationic salt.

BACKGROUND OF THE INVENTION

Image graphics are omnipresent in modern life. Images and data that warn, educate, entertain, advertise, etc. are applied on a variety of interior and exterior, vertical and horizontal surfaces. Nonlimiting examples of image graphics range from advertisements on walls or sides of trucks, posters that advertise the arrival of a new movie, warning signs near the edges of stairways.

The use of thermal and piezo inkjet inks have greatly increased in recent years with accelerated development of inexpensive and efficient inkjet printers, ink delivery systems, and the like.

Thermal inkjet hardware is commercially available from a number of multinational companies, including without limitation, Hewlett-Packard Corporation of Palo Alto, Calif., USA; Encad Corporation of San Diego, Calif., USA; Xerox Corporation of Rochester, N.Y., USA; LaserMaster Corporation of Eden Prairie, Minn., USA; and Mimaki Engineering Co., Ltd. of Tokyo, Japan. The number and variety of printers changes rapidly as printer makers are constantly improving their products for consumers. Printers are made both in desk-top size and wide format size depending on the size of the finished image graphic desired. Nonlimiting examples of popular commercial scale thermal inkjet printers are Encad's NovaJet Pro printers and H-P's 650C, 750C, and 2500CP printers. Nonlimiting examples of popular wide format thermal inkjet printers include H-P's DesignJet printers, where the 2500CP is preferred because it has 600×600 dots/inch (dpi) resolution with a drop size in the vicinity of about 40 picoliters.

3M markets Graphic Maker Inkjet software useful in converting digital images from the Internet, ClipArt, or Digital Camera sources into signals to thermal inkjet printers to print such image graphics.

Inkjet inks are also commercially available from a number of multinational companies, particularly 3M which markets its Series 8551; 8552; 8553; and 8554 pigment-based inkjet inks. The use of four principal colors: cyan, magenta, yellow, and black (generally abbreviated "CMYK") permit the formation of as many as 256 colors or more in the digital image.

Media for inkjet printers are also undergoing accelerated development. Because inkjet imaging techniques have become vastly popular in commercial and consumer applications, the ability to use a personal computer to digitally print a color image on paper or other receptor media has extended from dye-based inks to pigment-based inks. And the media must accommodate that change. Pigment-based inks provide more durable images because pigment particles are contained in a dispersion before being dispensed using a thermal inkjet print head.

Inkjet printers have come into general use for wide-format electronic printing for applications such as, engineering and architectural drawings. Because of the simplicity of operation and economy of inkjet printers, this image process holds a superior growth potential promise for the printing industry to produce wide format, image on demand, presentation quality graphics.

Therefore, the components of an inkjet system used for making graphics can be grouped into three major categories:

1 Computer, software, printer.

2 Ink.

3 Receptor medium.

The computer, software, and printer will control the size, number and placement of the ink drops and will transport the receptor medium through the printer. The ink will contain the colorant which forms the image and carrier for that colorant. The receptor medium provides the repository which accepts and holds the ink. The quality of the inkjet image is a function of the total system. However, the composition and interaction between the ink and receptor medium is most important in an inkjet system.

Image quality is what the viewing public and paying customers will want and demand to see. From the producer of the image graphic, many other obscure demands are also placed on the inkjet media/ink system from the print shop. Also, exposure to the environment can place additional demands on the media and ink (depending on the application of the graphic). Most common, durability of the image graphic is required in humid indoor or outdoor environments, especially locations capable of being soaked with rain or melting snow or ice.

Current inkjet receptor media are direct coated with a dual layer receptor medium according to the disclosure contained in U.S. Pat. No. 5,747,148 (Warner et al.) and are marketed by 3M under the brands 3M™ Scotchcal™ Opaque Imaging Media 3657-10 and 3M™ Scotchcal™ Translucent Imaging Media 3637-20. Other products marketed by 3M include Nos. 8522CP and 8544CP Imaging Media, the former having a coating on the imaging surface for controlling dot gain and the latter having a pigment management system and a fluid management system in pores of the membrane. With the rapid rise in usage of inkjet printing systems to create wide format graphics having digitally-produced images thereon, more and better inkjet receptor media are needed, especially those which rise to the level of precision and lighting requirements that are used for photographically-created image graphics.

These media have coatings provided by water-borne systems, either for entirely water-soluble or water-dispersible ingredients. Water-soluble ingredients are susceptible to loss of durability of the image graphic when encountering humid or wet environments. Most often, the image is created by printing of a water-based ink needs to be fixed to prevent ink migration and loss of precision of the image graphic. Water-dispersible ingredients are particularly difficult to handle during manufacturing to provide reproducible image receptive layers on substrates; working with emulsion-based delivery of coatings introduces a number of additional manufacturing factors that can affect efficiency and productivity.

SUMMARY OF INVENTION

An image receptor medium, comprising a non-porous base medium having on one major surface an imaging layer. The imaging layer comprises a) water insoluble binder, b) water insoluble and organic-solvent insoluble particles having a mean particle size of about 1 $\mu$m to 25 $\mu$m, and c) organic-solvent soluble multivalent cationic salt. The imaging layer comprises a plurality of pores capable of imbibing a liquid ink.

DETAILED DESCRIPTION

The present invention provides a way to create a very ink receptive coating on a non-porous medium. Thus, any non-porous medium can be provided with a porous image receptive layer that provides excellent ink imbibing properties, in combination with excellent rapid ink fixing properties. Because the binder is insoluble in water, the medium is highly water and humidity resistant.

This invention has particular utility for the production of image graphics using wide format inkjet printers and pigment-based ink. This invention solves the problem of obtaining precise digitally-produced image graphics with ink migration inhibitors on inkjet receptor media to endure water-laden environments that would otherwise cause the image graphic to lose precision.

With such precise, durable image graphics capable of being produced with inkjet receptor media of the present invention, one skilled in the art can replace photographically-created image graphics with digitally-created image graphics using inkjet inks. In other words, image graphics of the present invention have the precision and lighting requirements essentially consistent with image graphics prepared from photographic techniques. But digitally-created image graphics have the huge advantage of being electronically distributable over telecommunications equipment. Thus, one skilled in the art can distribute an image to many physically remote locations using secure data transmission lines or the Internet for later inkjet printing at such remote locations. The means of communication coupled with the media capable of printing durable, precise image graphics changes the way companies or organizations warn, educate, entertain or advertise in brilliant multicolor image graphics.

Moreover, media of the present invention can be illuminated from their viewing side, a reflective lighting property, or can be illuminated from its non-viewing side, a transmissive lighting property. Thus, the brilliant multicolor image graphics are capable of being viewed in natural or artificial light without loss of its color qualities regardless of the location of the light source.

The base medium is a non-porous film suitable for either or both backlit (transmissive) and opaque (reflective) viewing applications. Preferably, the base medium is particularly suitable for rigid "drop-in" type backlit signage materials for lightboxes. Therefore, another aspect of the invention is a combination of translucent sheets or transparent sheets and an inkjet receptor medium as above, which is also translucent, thereby producing a "drop-in" backlit image graphic. When coated onto clear polyester film, the dried coating layer can act both as a diffuser with good light transmission and also act as the imaging layer described above.

After printing an image using an ink jet printer with either dye or pigment-based inks, the inkjet receptor medium of the present invention may give a translucent graphic viewable on a lightbox with both the light on and off.

Another aspect of the present invention is a method of making the inkjet receptor medium identified above, where a solvent-based coating formulation as described below is applied to the non-porous base medium on one major surface thereon, and then the solvent is evaporated to form an imaging layer.

Yet another aspect of the present invention is an inkjet receptor medium that has an imaging layer and also an image printed thereon, whereby the image after drying is fixed by hot-rolling. This finished article therefore comprises in order, a base film (such as a polyester), a hot-melt adhesive layer, and a porous coating which acts as an ink jet receptive layer giving good images.

In another embodiment, the article is printed, allowed to dry, and hot-roll laminated with a hot-melt adhesive overlaminate, and the image is thereby encapsulated between the two layers of the hot-melt adhesive. The porous coating transparentizes somewhat showing the ingress of the hot-melt material into the pores, and so the image is now protected from direct exposure to the elements such as water and direct exposure to air. After encapsulation, the rub resistance and strength of the coating improves because the layer is now more of a continuous film and not weakened by the frequent pores which have been at least partially filled by the hot-melt material.

An advantage of the invention is the solvent-based coating formulation minimizes manufacturing complexities of delivering a coating layer to a base medium.

Other features and advantages will be explained in relation to the following embodiments of the invention.

Non-Porous Base Medium

The base medium useful for the present invention can be any polymeric material that can be uniformly coated by a solvent-based coating formulation to generate an inkjet receptor medium of the present invention. The base medium can be transparent, clear, translucent, colored, non-colored, or opaque, or a combination thereof, as required by those creating the image graphic.

The base medium preferably has a thickness ranging from about 25 microns to about 750 microns and more preferably from about 50 microns to about 250 microns.

The base medium can be rigid, flexible, elastic, or otherwise, again as required by those creating the image graphic.

Nonlimiting examples of polymers useful in the creation of the base medium include polyolefins, polyurethanes, polyesters, acrylics, polycarbonates, polyvinyl chlorides and other vinyl polymers and copolymers, polystyrenes. Presently preferred is a polyester film in the range of thickness from about 110 to about 180 $\mu$m thickness due to low cost and handling.

The size of the base medium is only limited by the capacity of the printer through which the medium can pass for printing. Printers directed to personal or business usage are usually small-format, i.e., less than about 56 cm printing width, whereas printers directed to commercial or industrial usage are usually large-format, i.e., greater than that printing width of 56 cm. As the digital revolution in image graphics continues to occur, many more uses of inkjet printers will be found, especially for those industries that distribute an image to many locations before printing it.

Imaging Layer

Solvent-soluble Multivalent Cationic Salts

Solvent-soluble multivalent cationic salts used in the present invention provide a critical element for precise, durable image graphics: inhibition of ink migration on an imaging layer in the presence of water, where the imaging layer is water-insoluble. These cationic salts interact with the pigment particles of the ink to fix such pigment particles within the porous imaging layer.

Nonlimiting examples of solvent-soluble multivalent cationic salts include those salts composed of cations selected from the group consisting of zinc, aluminum, calcium, magnesium, chromium, and manganese and anions selected from the group consisting of chloride, bromide, iodide, and nitrate.

Preferred examples of such salts include anhydrous zinc bromide, anhydrous calcium bromide, and anhydrous calcium chloride.

The amount of salts that can be used in the coating solution for coating the base medium range from about 0.1% to about 10% and preferably from about 0.75% to about 3% weight percent of the solids of the coating formulation.

Solvent

Organic solvents used in the present invention are capable of solvating the solvent-soluble multivalent cationic salts and other ingredients of the coating formulation preferably alone, or in a mixtures with another organic solvent. Nonlimiting examples of such organic solvents include ketones such as methyl ethyl ketone, acetone, isobutyl ketone, cyclohexanone and methyl isobutyl ketone; hydrocarbons such as cyclohexane, heptane, toluene, and xylenes; alcohols such as ethanol, butanol, isopropanol, pentanol; mineral oils; esters such as ethyl acetate, and butyl acetate; PM acetate; carbitol acetate; and glycol alkyl ethers and combinations thereof. Preferred organic solvents for the present invention have limited adverse environmental effects. Particularly preferred organic solvents have a boiling point between about 80° C. to about 160° C.

Binder

Preferred binders for retaining the solvent-soluble multivalent cationic salts in the imaging layer have low cost, easy manufacturing and processing features, and can form tough layers on base media described above, with or without the use of a priming layer between the imaging layer and the base medium. These are water-insoluble, and binders should be soluble in the solvent used for the coating formulation to assure even delivery of the coating to the base medium.

Nonlimiting examples of binders include acrylic acid copolymers, poly(meth)acrylates, polyvinyl acetals (such as polyvinyl butyra and polyvinyl formal) vinyl acetate copolymers, polyurethanes, vinyl chloride polymers and copolymers such as VYNS (a copolymer of vinyl chloride and vinyl acetate from Union Carbide of Danbury, Conn., USA), VAGH (a terpolymer of vinyl chloride, vinyl acetate and vinyl alcohol from Union Carbide of Danbury, Conn., USA) and the like known to those skilled in the art for producing high quality, low cost layers in laminate constructions. These binders are readily commercially available as resins from large and small manufacturers. Particularly preferred as binders for the present invention include Paraloid B82 brand methyl methyacrylate polymer from Rohm and Haas of Philadelphia, Pa., USA; and VYHH (a copolymer of vinyl chloride and vinyle acetate from Union Carbide of Danbury, Conn., USA).

The amount of binder that can be used in the coating solution for coating the base medium range from about 10% to about 50% and preferably from about 20% to about 40% weight percent of the total coating solids.

Particulate

The coating formulation includes particulates in an amount and size sufficient to assist in providing a porous structure in the ultimate imaging layer. Additionally, the particles may provide surface variation and protection of the pigment-based particles delivered in the inkjet inks for the final product. Nonlimiting examples of particulates include those disclosed in the prior art such as starch, silica, zeolites, clay articles, insoluble silicates such as calcium silicate, alumina, talc, titanium dioxide and the like. Because the coating formulation is solvent-based, the particulates need to be insoluble in the solvents used in the coating formulations. Moreover, it has been found in this invention that a crosslinked polyvinylpyrrolidone particle is particularly useful for providing a good image when printed with both pigment or dye-based aqueous ink jet inks. It is also an advantage that a receptor medium such as described, while primarily of use in receiving pigment-based ink jets to give a water-fast fade-resistant image, can also optionally be used to print with dye-based inks. Such crosslinked polyvinylpyrrolidone particles are commercially available from a number of sources in a number of particle size distributions, including BASF of Wyandotte, Mich., USA under the Luvicross® M brand.

Mean particle size for the particulates can range from about 1 $\mu$m to about 25 $\mu$m and preferably from about 4 $\mu$m to about 15 $\mu$m.

When a crosslinked polyvinylpyrrolidone particulate is used with a binder and a solvent-soluble multivalent cationic salt in the coating formulation, the amount of particulate to be used is determined by its weight/weight ratio with the binder. The particulate:binder W/W (weight/weight) ratio can range from about 1:1 to about 9:1 and preferably from about 1.7:1 to about 2.0:1 and most preferably about 1.8:1. Other particulates may require a different W/W ratio with the binder because it is really the V/V (volume/volume) ratio that concerns the imaging layer after the solvent has evaporated for the binder to hold the particulates in place adequately.

Because the base medium is a solid film without any discernable porosity, the present imaging layer comprising particulates with the binder and the solvent-soluble multivalent cationic salts in the coating formulation inherently provides a porosity for the imaging layer. While not being bound by theory, it is believed that a porous coating layer is formed from the evaporation of solvent from the coating formulation, leaving a disorganized collection of particulates bound by the binder within which the solvent-soluble multivalent cationic salts reside. The pores are able to quickly imbibe the ink providing a quick drying medium. This porous structure may be facilitated by the use of particulates that are irregular in shape (e.g. non-spherical). The imaging layer is not unlike the popular confection of "peanut brittle" with the binder holding together the particulate "peanuts" and enormous porosity in the binder "brittle" formed by solvent evaporation.

Optional Priming Layer

Depending on the type of base medium, to provide an excellent surface for the imaging layer, a priming layer can be provided between the base medium and the imaging layer delivered by the solvent-based system. Nonlimiting examples of such priming layers include poly(vinylidene chloride) or solvent-adhesion primers such as found on Mitsubishi Diafoil 4507 brand polyester (available from Mitsubishi Polyester Film, 2001 Hood Road, P.O. Box 1400, Greer, S.C. 29652).

Alternatively or in addition to priming the base medium, surface alteration treatments can be used to enhance adhesion to the base film such as corona treatment, surface ablation, surface abrasion, and the like known to those skilled in the art.

Optional Adhesive Layer and Optional Release Liner

The receptor medium optionally has an adhesive layer on the opposite major surface of the base medium that is optionally but preferably protected by a release liner. After imaging, the image receptor medium can be adhered to a horizontal or vertical, interior or exterior surface to warn, educate, entertain, advertise, etc.

The choice of adhesive and release liner depends on usage desired for the image graphic.

Pressure sensitive adhesives can be any conventional pressure sensitive adhesive that adheres to both membrane and to the surface of the item upon which the inkjet receptor medium having the permanent, precise image is destined to be placed. Pressure sensitive adhesives are generally described in Satas, Ed., *Handbook of Pressure Sensitive Adhesives* 2nd Ed. (Von Nostrand Reinhold 1989), the disclosure of which is incorporated by reference. Pressure sensitive adhesives are commercially available from a number of sources. Particularly preferred are acrylate pressure sensitive adhesives commercially available from Minnesota Mining and and Manufacturing Company of St. Paul, Minn. and generally described in U.S. Pat. Nos. 5,141,790, 4,605,592, 5,045,386, and 5,229,207 and EPO Patent Publication EP 0 570 515 B1 (Steelman et al.). Another suitable adhesive is disclosed in copending, coassigned, U.S. patent application Ser. No. 08/775,844, now U.S. Pat. No. 6,197,397, the disclosure of which is incorporated by reference.

Release liners are also well known and commercially available from a number of sources. Nonlimiting examples of release liners include silicone coated kraft paper, silicone coated polyethylene coated paper, silicone coated or non-coated polymeric materials such as polyethylene or polypropylene, as well as the aforementioned base materials coated with polymeric release agents such as silicone urea, urethanes, and long chain alkyl acrylates, such as defined in U.S. Pat. Nos. 3,957,724; 4,567,073; 4,313,988; 3,997,702; 4,614,667; 5,202,190; and 5,290,615; the disclosures of which are incorporated by reference herein and those liners commercially available as Polyslik brand liners from Rexam Release of Oakbrook, Ill., USA and EXHERE brand liners from P.H. Glatfelter Company of Spring Grove, Pa., USA.

Alternatively, one can provide mechanical fasteners on the opposing surface as disclosed in copending, coassigned, U.S. patent application Ser. No. 08/930,957, the disclosure of which is incorporated by reference.

When used in a "drop-in" backlit condition, the inkjet receptor medium has no adhesive or mechanical fasteners on the opposing major surface of the medium, although adhesives and fasteners can be limited to perimeter regions of the medium to secure the imaged medium to supporting rigid sheets. The translucent coating applied to a transparent or translucent receptor medium can also be used in second surface applications, for example by affixing the imaged graphic on the inside of a transparent viewing surface such as a window or the plastic front of a lightbox, vending machine etc. using a transparent double-sided sheet adhesive such as 8560 application adhesive (available from 3M Commercial Graphics Division, 3M Center, Maplewood, Minn. 55144-1000).

Optional Additives

Optional additives to the imaging layer could include coparticulates such as silica or titanium dioxide to increase optical opacity. Such coparticulates may optionally be less than 1 $\mu$m, and preferably between about 10 and about 100 nanometers in size. Also optionally added are UV and/or heat stabilizers such as hindered amine light stabilizers (HALS), UV absorbers, antioxidants and heat-stabilizers. Such additives are well known in the art and are available from companies such as Ciba Geigy Additives (7 Skyline Drive, Hawthorne, N.Y. 10532-2188), Cytec Industries Inc. (P.O. Box 426, Westmont, Ill. 60559-0426), Sandoz (4000 Monroe Road, Charlotte, N.C. 28205) or BASF (BASF Aktiengesellschaft Farbmittel und ProzeBchemikalien, 67056 Ludwigshafen, Germany). Other additives could include cobinders, plasticizers for the binders present, and surfactants.

Preparation of the Coating Formulation and Delivery to the Base Medium

The coating formulation is solvent-based and uncomplicated to prepare because the various ingredients except the particulate are preferably soluble in the solvent chosen. For purposes of the present invention, a "solvent based coating formulation" is a formulation wherein the majority of the materials present in the formulation that are liquid at room temperature are organic materials. Such formulations may additionally comprise water in smaller proportions. Preferably, the solvent based coating formulation comprises less than 30% water, more preferably less than 20% water, and most preferably less than 10% water. The coating formulation should be thoroughly mixed and the resulting dispersion screened to assure an appropriate size of particulate for the wet coating weight desired for the formation of the imaging layer. The coating formulation is preferably shelf stable, so that it does not form a non-reversible agglomeration during the expected duration between preparation of the coating formulation and application to an intended non-porous base medium.

The coating formulation can be applied in a thickness to the base medium depending on the amount of ink likely to be printed on the inkjet receptor medium. Preferably, the solvent based coating formulation has a wet coating thickness from about 50 $\mu$m to about 500 $\mu$m, and preferably from about 152 $\mu$m (6 mils) to about 200 $\mu$m (8 mils) when the solution is approximately 32.5% solids (weight solids to weight of solution) and the particulate is Luvicross M and the binder is Paraloid B82 and the weight ratio of particulate to the binder is 1.8.

The imaging layer preferably has a dry coating weight ranging from about 20 g/m$^2$ to about 80 g/m$^2$ and preferably from about 25 g/m$^2$ to about 60 g/m$^2$.

Preferably, the void volume of the pores is 20% to 80% of the dried imaging layer volume. More preferably, the void volume of the pores is 30% to 60% of the dried imaging layer volume. Void volume is evaluated by any appropriate means in the art, such as imbibing the image layer with a liquid material to determine the volume available for such liquid, estimation using photomicrographs or other visual techniques, or calculation by determining overall volume and subtracting actual image layer volume by density determination. An Evaluation technique is mercury pore symmetry.

Optional Encapsulation of Image Graphics

While the image graphic created by pigment particles inhibited from migration alone can avoid the use of clear coats or overlaminates yet retain durable, precise image graphics, an optional additional step in the formation of the final image graphic is desired. This step could also protect images made by printing with dye-based inks. When the particulates are present in the imaging layer and the solvent has evaporated, an inherent, porosity has been formed. The image can be fixed through the use of heat and pressure in the location where it was printed when an adjacent hot-melt layer is present or if the particulates were to melt into the binder. Thus, the solvent-soluble multivalent cationic salts provide a rapid ink fixing, whereas this optional hot melt processing step provides an additional and highly durable ink fixing.

The coating formulation gives fine quality ink jet images when printed on an HP Designjet 2500CP or HP Designjet 3500CP printer. When coated onto a clear polyester film as the base medium, the imaging layer produces good graphics (when printed) for lightbox applications, both with and without a diffuser. The use of solvent-soluble multivalent cationic salts in the imaging layer of the present invention imparts a good degree of water-resistance to the images after printing with pigment-based aqueous inkjet inks from an inkjet printer, and also some improvement in the water-resistance to dye images printed by ink jet.

The coatings can also be applied to opaque base films giving good inkjet receptor media which dry very quickly to the touch. Because solvent-soluble multivalent cationic salts are used in these opaque imaging applications, both an increase in water-resistance and improvement in reflected viewing density are seen.

The coatings with ink fixing abilities therefore show utility as an imaging layer for an inkjet receptor medium that can be applied to a base film (or other sheet material, e.g. paper, synthetic paper etc.) and be printed using an inkjet printer to give a poster, banner, or other type of image graphic which is substantially water-resistant without the need for a clear coat or overlaminate, and can be put outside for at least a short period of time without the ink running in rain.

The hot-melt encapsulation articles and processes are useful because they provide a method by which a fabricator can print a graphic using ink jet printing, and then pass the material through a hot laminator (potentially with or without the use of a hot-melt overlaminate) and encapsulate the image. The resultin imaged graphic is water-fast and protected from the elements and could be put outside even under harsh conditions. The encapsulation of the coating, which involves filling the pores, makes the coating and therefore the resultant image much tougher, more water resistant, and potentially more UV-resistant.

Further embodiments are found in the following non-limiting Examples.

Examples 1–6 and Comparative Examples A–K

Coating Formulations

All coating formulations were made by (1) dissolving binder solids into an organic solvent (in the case of the Paraloid A10S example a 12.5% solids solution was made by diluting 83.34 g of the Paraloid A10S—supplied as 30% solids in ethyl acetate—with 116.66 g of methyl ethyl ketone); (2) dissolving the salt into another organic solvent and then adding deionized water for Example 1 only; (3) mixing the binder solution and the salt or the salt solution for Example 1 only; (4) adding the optional particulates and mixing in with an overhead stirrer, and then high-shear mixing on a Silverson L4R disperser fitted with a standard head with a disintegrating screen. Comparison Examples omit the addition of the salt into the solution.

Delivery of Coating Formulations

All resulting formulations were coated at a wet notch bar gap of 6 mils (152 $\mu$m) onto 3.8 mil (97 $\mu$m) gauge translucent polyester with PVDC prime layer and dried for two minutes at 230° F. (110° C.).

Testing of Imaging Layers

All coated inkjet receptive media were printed with a test pattern with solid colors of cyan, magenta, yellow and black, red, green and blue about one inch square (2.54×2.54 cm) per color. Printing was carried out on a Hewlett-Packard Designjet 2500CP color ink jet printer fitted with Hewlett-Packard UV pigment-based inks, on UV Opaque Vinyl media setting on Best quality. Printing was done onto 8.5"×11" (21.6 cm ×28 cm) sheets of the different inkjet receptor media. The translucent printed inkjet media were placed against the white area of a Leneta Hiding Chart (Form 402C-2 from Leneta of Mahwah, N.J., USA) for the purpose of measuring reflective color. Reflective color optical densities were measured using a Gretag SPM-50 meter (D65, 2 degrees, Abs).

The printed media were then washed for one minute under a running deionized water tap flowing at approximately one litre per minute-the tap was directed over the seven squares of media for each color with approximately the same time for all colors under the tap.

The printed media were then allowed to dry overnight (approximately 16 hours) and then remeasured in the same way as before on the Leneta Hiding Chart. The density change was calculated for each color on each print and divided by the original density to give the fraction of the color that had been lost during the wash (delta D/D(0)).

Table 1 shows the coating formulations for the Examples and Comparative Examples.

Table 2 shows the Delta $D/D_0$ values for the Examples and Comparative Examples. The greater the negative value, the more loss of color occurred after washing of the image with deionized water. A value approaching 0.0 is optimum.

TABLE 1

| Example | % Solids of Binder in Solvent | Binder/ Solvent (g) | Luvicross M x-PVP (g) | % Solids of Salt in Solvent | Salt/ Solvent (g) | Salt in Binder/ Solvent (g) | Mixing Duration (min.) | Drying Temperature (° C.) |
|---|---|---|---|---|---|---|---|---|
| A | 12.5% Paraloid B48N in MEK | 160 | 40 | — | — | — | 2.5 | 110 |
| B | 12.5% ParaloidB82 in MEK | 160 | 40 | — | — | — | 2.5 | 110 |
| C | 12.5% VYHH in MEK | 160 | 40 | — | — | — | 2.5 | 110 |
| D | 12.5% ParaloidA10S in MEK/ethyl acetate | 160 | 40 | — | — | — | 2.5 | 110 |
| E | 12.5% Paraloid B72 in MEK | 160 | 80 | — | — | — | 2.5 | 110 |
| F | 12.5% Paraloid B67 in MEK | 160 | 80 | — | — | — | 2.5 | 110 |
| 1 | 21.48% Paraloid B82 in MEK | 69.29 | 29.76 | 0.7% $AlBr_3.6H_2O$ Acetone/D.I. $H_2O$ (96.3%/2.9%) | 50.975 | — | 5 | 110 |

TABLE 1-continued

| Example | % Solids of Binder in Solvent | Binder/ Solvent (g) | Luvicross M x-PVP (g) | % Solids of Salt in Solvent | Salt/ Solvent (g) | Salt in Binder/ Solvent (g) | Mixing Duration (min.) | Drying Temperature (° C.) |
|---|---|---|---|---|---|---|---|---|
| G | 12.5% Paraloid B82 in MEK | 80 | 20 | — | — | — | 2.5 | 110 |
| 2 | 12.5% Paraloid B82 in MEK | 80 | 20 | — | — | 0.15 g of $ZnBr_2$ | 2.5 | 110 |
| 3 | 12.5% Paraloid B82 in MEK | 80 | 20 | — | — | 0.30 g of $ZnBr_2$ | 2.5 | 110 |
| 4 | 12.5% Paraloid B82 in MEK | 80 | 20 | — | — | 0.75 g of $ZnBr_2$ | 2.5 | 110 |
| H | 12.5% Paraloid B82 in MEK | 40 | 10 | — | — | — | 5* | 100 |
| 5 | 12.5% Paraloid B82 in MEK | 40 | 10 | — | — | 0.3 g of $ZnBr_2$ | 5* | 100 |
| 6 | 12.5% Paraloid B82 in MEK | 40 | 10 | — | — | 0.18 g of $ZnCl_2$ | 5* | 100 |
| I | 12.5% Paraloid B82 in MEK | 40 | 10 | — | — | 0.23 g of LiBr | 5* | 100 |
| J | 12.5% Paraloid B82 in MEK | 40 | 10 | — | — | 0.5 g of $LiI.3H_2O$ | 5* | 100 |
| K | 12.5% Paraloid B82 in MEK | 40 | 10 | — | — | NaI | 5* | 100 |

*Mixing before addition of Salt into Particulate/Binder/Solvent
All Paraloid polymers from Rohm and Haas of Philadelphia, PA, USA
VYHH polymer from Union Carbide of Danbury, CT, USA

TABLE 2

| | | | Delta D/D(0) | | | | | | |
|---|---|---|---|---|---|---|---|---|---|
| Example | Binder Type | Salt Type | Cyan | Magenta | Yellow | Black | Red | Green | Blue |
| A | Paraloid B48N | None | −0.051 | −0.024 | −0.226 | −0.015 | −0.125 | −0.041 | −0.069 |
| B | Paraloid B82 | None | −0.037 | −0.266 | −0.449 | −0.650 | −0.236 | −0.228 | −0.051 |
| C | VYHH | None | 0.043 | 0.000 | 0.037 | −0.016 | 0.050 | 0.048 | 0.000 |
| D | Paraloid A10S | None | −0.255 | −0.650 | −0.679 | −0.156 | −0.445 | −0.549 | −0.508 |
| E | Paraloid B72 | None | −0.326 | −0.472 | −0.661 | −0.034 | −0.496 | −0.493 | −0.500 |
| F | Paraloid B67 | None | −0.378 | −0.449 | −0.780 | −0.124 | −0.716 | −0.723 | −0.444 |
| 1 | Paraloid B82 | $AlBr_3.6H_2O$ | −0.149 | −0.137 | −0.173 | −0.072 | −0.106 | −0.072 | −0.078 |
| G | Paraloid B82 | None | −0.358 | −0.505 | −0.533 | −0.115 | −0.393 | −0.400 | −0.389 |
| 2 | Paraloid B82 | 1% $ZnBr_2$ | −0.092 | −0.118 | −0.085 | −0.050 | −0.081 | −0.066 | −0.070 |
| 3 | Paraloid B82 | 2% $ZnBr_2$ | −0.088 | −0.101 | −0.098 | −0.013 | −0.066 | −0.057 | −0.054 |
| 4 | Paraloid B82 | 5% $ZnBr_2$ | −0.080 | −0.073 | −0.079 | 0.004 | −0.015 | −0.022 | −0.032 |
| H | Paraloid B82 | None | −0.122 | −0.323 | −0.494 | 0.015 | −0.177 | −0.177 | −0.164 |
| 5 | Paraloid B82 | $ZnBr_2$ | 0.021 | 0.025 | 0.018 | 0.026 | 0.093 | 0.100 | 0.080 |
| 6 | Paraloid B82 | $ZnCl_2$ | 0.010 | 0.024 | 0.012 | 0.007 | 0.044 | 0.070 | 0.146 |
| I | Paraloid B82 | LiBr | −0.121 | −0.321 | −0.508 | −0.038 | −0.261 | −0.271 | −0.121 |
| J | Paraloid B82 | LiI.3H2O | −0.249 | −0.361 | −0.440 | −0.044 | −0.105 | −0.141 | −0.144 |
| K | Paraloid B82 | NaI | −0.437 | −0.448 | −0.468 | −0.066 | −0.163 | −0.177 | −0.264 |

From a review of Table 2 for Comparison Examples A–F, one can see that the binder type is largely not material to differences in Delta D/D(0) for the various Additive (RGB) and Subtractive (CMYK) Primary Colors except for VYHH which apparently shows some ability to fix the inks. For the remainder of the Examples and Comparative Examples, Paraloid B82 was used, offering a direct comparison of Comparison Examples B, G, and H with Examples 1–6. While there was variation in the Delta D/D(0) values among the Comparison Examples B, G, and H probably due to variability in the simple test procedure, Examples 1–6 (using a hydrated $AlBr_3$ for Example 1 and anhydrous $ZnBr_2$ for the rest) had consistently better Delta D/D(0) values and the pattern is clear. The more detailed comparison between Comparison Example G and Examples 2–4 shows the consistent improvement in Delta D/D(0) values as a higher weight percentage of solvent-soluble multivalent cationic salts is added. Finally, Examples 5 and 6 are better than Comparison Examples I–K because the latter are monovalent cationic salts whereas Examples 5 and 6 are multivalent. Thus, the combination of Tables 1 and 2 demonstrate the unexpected ink migration inhibition using solvent-soluble multivalent cationic salts in the present invention.

Example 7

A solution was made up in a one gallon waterproof container by mixing methyl ethyl ketone (1822 g) and methyl isobutyl ketone (203 g), stirring, and adding pellets of Paraloid B82 (from Rohm & Haas) (345 g) and stirring vigorously with an overhead stirrer until the polymer had dissolved. Zinc bromide (anhydrous) (10 g) was added and mixed in until dissolved. Luvicross M powder was added (621 g) and mixed in well with the overhead stirrer. The mixture was then homogenized for ten minutes to break up any agglomerates of Luvicross M powder using a high speed Silversen L4R mixer at maximum speed to give a 32.5% solids mixture with a particle:binder ratio by weight (R) of 1.8:1 and a Brookfield viscosity of approximately 1000 cP at 30 RPM which is good for coating.

This formulation was coated onto 6.5 mil gauge (165 μm) Hostaphan 4507 transparent film available from Mitsubishi Polyester Film (formerly Hoechst Diafoil). The coating mixture was coated using a notch bar set at a gap of 8 mils (200 microns) above the film, and dried by passing through three drying oven zones of approximately 12 feet (3.66 meters) and one drying zone with a web path of approximately 24 feet (7.31 meters) at oven air temperatures of approximately 220° F.(104° C.), 240° F.(116° C.), 270° F.(132° C.) and 280° F.(138° C.). Web speed was 30 feet per minute (nine meters per minute).

The film is suitable for printing on a Hewlett-Packard Designjet 2500CP or 2000CP or 3500CP or 3000CP printer using either the HP UV inks (pigment-containing) or the Imaging inks (dye-containing) and using for a backlit image in a conventional lightbox. Truly durable and precise images were obtained. With resolution of these printers at least at 600 dots per inch (dpi), the images can approach photographic quality with the benefit of the image being printed digitally. The use of a transparent film as the base medium is transformed into a diffuser film with the addition of the imaging layer of the present invention because the imaging layer has a tremendously varied surface and interior which scatters and diffuses light from a backlit source.

What is claimed is:

1. An image receptor medium, comprising a non-porous base medium having on one major surface an imaging layer, said imaging layer comprising:

a) water insoluble polymeric binder;

b) water insoluble and organic-solvent insoluble particles having a mean particle size of about 1 μm to 25 μm; and c) organic-solvent soluble anhydrous multivalent cationic salt, wherein the organic-solvent soluble multivalent cationic salt is soluble in methyl ethyl ketone, and is composed of a cation selected from the group consisting of zinc, aluminum calcium, chromium, and manganese and an anion selected from the group consisting of chloride, bromide, iodide, and nitrate;

said imaging layer comprising a plurality of pores capable of imbibing a liquid ink.

2. The medium of claim 1, wherein the particles are crosslinked poly(vinyl pyrrolidone) particulates.

3. The medium of claim 1, wherein the binder is selected from the group consisting of acrylic acid copolymers, poly (meth)acrylates, vinyl acetate copolymers, polyvinyl acetals, polyurethanes, vinyl chloride polymers and copolymers and combinations thereof.

4. The medium of claim 1, wherein the imaging layer has a wet coating thickness from about 50 μm to about 500 μm.

5. The medium of claim 1, wherein the amount of salt ranges from about 0.1 weight percent to about 10 weight percent of the imaging layer; wherein the amount of binder ranges from about 10 to about 50 weight percent of the imaging layer; and wherein the weight ratio of particulate-:binder ranges from about 1:1 to about 9:1.

6. The medium of claim 5, wherein the dry coating weight of the imaging layer ranges from about 20 $g/m^2$ to about 80 $g/m^2$.

7. The medium of claim 1, further comprising an adhesive layer on an opposing major surface of the base medium.

8. The medium of claim 1, further comprising a mechanical fastener on an opposing major surface of the base medium.

9. The medium of claim 1, wherein said pores have a void volume of 20% to 80% of the dried imaging layer volume.

10. The medium of claim 1, wherein said pores have a void volume of 30% to 60% of the dried imaging layer volume.

11. The medium of claim 1, wherein the organic-solvent soluble anhydrous multivalent cationic salt comprises anhydrous zinc bromide, anhydrous calcium bromide or anhydrous calcium chloride.

12. The medium of claim 1, further comprising a primer layer between the non-porous base medium and the imaging layer.

13. The medium of claim 12, wherein the primer layer comprises poly(vinylidene chloride) or polyester.

14. The medium of claim 1, wherein the non-porous base medium comprises polyolefin, polyurethane, polyester, acrylic, polycarbonate, polyvinyl chloride, or polystyrene.

15. The medium of claim 1, wherein the non-porous base medium comprises a polyester film having a thickness from 110 to 180 μm.

16. The medium of claim 1, wherein the imaging layer consists essentially of:

a) water insoluble polymeric binder;

b) water insoluble and organic-solvent insoluble particles having a mean particle size of about 1 μm to 25 μm;

c) organic-solvent soluble multivalent anhydrous cationic salt, wherein the organic-solvent soluble multivalent cationic salt is soluble in methyl ethyl ketone; and optionally d) one or more additives selected from the group consisting of silica, titanium dioxide, a UV stabilizer, a heat stabilizer, a hindered amine light stabilizer, a UV absorber, an antioxidant, plasticizers, and surfactants.

17. The medium of claim 1, wherein the imaging layer comprises a single polymeric binder, wherein the single polymeric binder is a water insoluble polymeric binder selected from the group consisting of acrylic acid copolymers; poly(meth)acrylates; polyvinyl acetals; polyvinyl butyral; polyvinyl formal; vinyl acetate copolymers; polyurethanes; vinyl chloride polymers; a copolymer of vinyl chloride and vinyl acetate; a terpolymer of vinyl chloride, vinyl acetate and vinyl alcohol; and methyl methacrylate polymer.

18. An image receptor medium, comprising a non-porous polymeric film having on one major surface an imaging layer, said imaging layer comprising:

a) water insoluble polymeric binder;

b) water insoluble and organic-solvent insoluble particles having a mean particle size of about 1 μm to 25 μm, wherein the particles are crosslinked poly(vinyl pyrrolidone) particulates; and c) organic-solvent soluble anhydrous multivalent cationic salt;

said imaging layer comprising a plurality of pores capable of imbibing a liquid ink.

19. The medium of claim 18, wherein the organic-solvent soluble anhydrous multivalent cationic salt comprises anhydrous zinc bromide, anhydrous calcium bromide or anhydrous calcium chloride.

20. The medium of claim 18, wherein the imaging layer comprises water insoluble polymeric binder selected from the group consisting of acrylic acid copolymers; poly(meth) acrylates; polyvinyl acetals; polyvinyl butyral; polyvinyl formal; vinyl acetate copolymers; polyurethanes; vinyl chloride polymers; a copolymer of vinyl chloride and vinyl acetate; a terpolymer of vinyl chloride, vinyl acetate and vinyl alcohol; methyl methacrylate polymer, or a combination thereof.

21. An image receptor medium, comprising:

(I) a non-porous base medium; and (II) an imaging layer on one major surface of the non-porous base medium, wherein the imaging layer comprises:

a) water insoluble polymeric binder;

b) water insoluble and organic-solvent insoluble particles having a mean particle size of about 1 $\mu$m to 25 $\mu$m; and c) organic-solvent soluble multi-valent anhydrous cationic salt consisting of anhydrous zinc bromide, anhydrous calcium bromide or anhydrous calcium chloride;

said imaging layer comprising a plurality of pores capable of imbibing a liquid ink.

22. The medium of claim 21, wherein the particles are crosslinked poly(vinyl pyrrolidone) particulates.

* * * * *

UNITED STATES PATENT AND TRADEMARK OFFICE

CERTIFICATE OF CORRECTION

PATENT NO. : 6,677,007 B1 
DATED : January 13, 2004
INVENTOR(S) : Warner, Elizabeth A.

It is certified that error appears in the above-identified patent and that said Letters Patent is hereby corrected as shown below:

Title page,
Item [56], References Cited, OTHER PUBLICATIONS,
"*Encyclopedia of Polymer*" reference, delete "Structurual" and insert -- Structural --.
"International Specialty Products (brochure), Industrial" reference, delete "Polyvinylpryrrolidone" and insert -- Polyvinylpyrrolidone --.
"International Specialty Products (brochure), Polyvinylpyrrolidone" reference, delete "gs." insert -- pgs. --.

Column 5,
Line 35, "butyra" and insert -- butyral --.
Line 47, delete "methyacrylate" and insert -- methacrylate --.
Line 49, delete "vinyle" and insert -- vinyl --.
Line 63, delete "articles" and insert -- particles --.

Column 6,
Line 5, after "jets" insert -- inks --.

Column 7,
Line 12, delete "and" before "Manufacturing".
Line 64, delete "ProzeBchemikalien" and insert -- Prozeßchemikalien --.

Column 12,
Lines 62 and 65, delete "Luvicross M" and insert -- Luvicross® M --.

Column 13,
Line 38, after "aluminum" insert -- , --.

Column 14,
Line 66, delete "polymer," insert -- polymer; --.

UNITED STATES PATENT AND TRADEMARK OFFICE

CERTIFICATE OF CORRECTION

PATENT NO. : 6,677,007 B1
DATED : January 13, 2004
INVENTOR(S) : Warner, Elizabeth A.

It is certified that error appears in the above-identified patent and that said Letters Patent is hereby corrected as shown below:

Column 16,
Line 1, delete "multi-valent" insert -- multivalent --.

Signed and Sealed this

Twenty-second Day of November, 2005

JON W. DUDAS
*Director of the United States Patent and Trademark Office*